US009776410B2

(12) United States Patent
Ono et al.

(10) Patent No.: US 9,776,410 B2
(45) Date of Patent: Oct. 3, 2017

(54) METHOD OF MANUFACTURING LIQUID DISCHARGE HEAD

(71) Applicant: CANON KABUSHIKI KAISHA, Tokyo (JP)

(72) Inventors: Takayuki Ono, Kawasaki (JP); Masao Furukawa, Yokohama (JP); Masashi Ishikawa, Chofu (JP); Jun Hinami, Kawasaki (JP); Takeshi Shibata, Yokohama (JP); Ryo Shimamura, Yokohama (JP); Takanori Enomoto, Tokyo (JP); Shimpei Otaka, Kawasaki (JP); Tomohiro Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 770 days.

(21) Appl. No.: 14/169,501

(22) Filed: Jan. 31, 2014

(65) Prior Publication Data

US 2014/0216630 A1 Aug. 7, 2014

(30) Foreign Application Priority Data

Feb. 1, 2013 (JP) ..... 2013-018308

(51) Int. Cl.

| | |
|---|---|
| ***B41J 2/17*** | (2006.01) |
| ***B41J 2/16*** | (2006.01) |
| ***B41J 2/14*** | (2006.01) |

(52) U.S. Cl.

CPC ..... *B41J 2/16* (2013.01); *B41J 2/14024* (2013.01); *B41J 2/1603* (2013.01); *B41J 2/1623* (2013.01)

(58) Field of Classification Search

CPC ... B41J 2/17; B41J 2/175; B41J 2/1623; B41J 2/14024

See application file for complete search history.

(56) References Cited

U.S. PATENT DOCUMENTS

2009/0309938 A1* 12/2009 Yoneda ..... B41J 2/1603 347/85

FOREIGN PATENT DOCUMENTS

| | | | | |
|---|---|---|---|---|
| JP | 2009-298108 A | 12/2009 | | |
| WO | WO 2013191677 A1 * | 12/2013 | ..... | B41J 2/14024 |
| WO | WO 2014046652 A1 * | 3/2014 | ..... | B41J 2/14145 |

* cited by examiner

*Primary Examiner* — Jeff Aftergut
*Assistant Examiner* — Jaeyun Lee
(74) *Attorney, Agent, or Firm* — Canon U.S.A. Inc., IP Division

(57) ABSTRACT

A method of manufacturing a liquid discharge head in which a device substrate having an energy generating element and a supply port and a supporting member having a supply passage are bonded with each other an adhesive agent includes:

a first step of applying the adhesive agent to an end surface of a wall;

a second step of flattening out the adhesive agent on the end surface of the wall of the supply port in the height direction intersecting the end surface by moving the end surface of the wall of the supply port and the end surface of the wall of the supply passage toward each other; and a third step of moving the ridge line of the wall of the supply port in a direction along the end surface of the wall of the supply port.

8 Claims, 6 Drawing Sheets

METHOD OF MANUFACTURING LIQUID DISCHARGE HEAD

BACKGROUND OF THE INVENTION

Field of the Invention

This disclosure relates to a method of manufacturing a liquid discharge head in which a device substrate having an energy generating element is positioned on and fixed to a supporting member with an adhesive agent.

Description of the Related Art

An ink jet printhead configured to discharge ink as a liquid includes a printing device substrate having a heater for discharging ink and a supporting member configured to support a printing device substrate. The printing device substrate includes a supply port through which ink is supplied. The supporting member includes a supply passage configured to supply ink to the supply port of the printing device substrate.

In an ink jet printhead of this type, an end surface of a wall which forms the supply port of the printing device substrate is fixed to an end surface of a wall which forms the supply passage of the supporting member with an adhesive agent. A method of manufacturing the inkjet printhead includes a step of applying an adhesive agent onto the end surface of the wall of the supply passage, and a step of positioning the printing device substrate with respect to the supporting member and bonding the wall of the supply port and the wall of the supply passage with an adhesive agent.

In the related art, when the printing device substrate is positioned relative to and fixed to the supporting member with an adhesive agent, the following fixing method as described below is employed. Japanese Patent Laid-Open No. 2009-298108 discloses a method in which a supporting member to which an adhesive agent is applied is positioned with respect to a positioning device or a jig, and then the printing device substrate is positioned at a predetermined position with reference to the positioning device or the jig to which the supporting member is positioned, thereby sticking the printing device substrate to the supporting member.

However, in the method of the related art, there is a problem as described below.

FIG. 6 shows a positional relationship between a wall which forms a supply port of a printing device substrate and a wall which forms a supply passage of the supporting member in a case where variations occur in dimensional accuracy of the supporting member in a method of fixing the printing device substrate and the supporting member of the related art.

As illustrated in FIG. 6, a wall 111*a* of a supply port 111 of a printing device substrate 106 having an energy generating element and a wall 112*a* of a supply passage 112 of a supporting member 107 are fixed to each other with an adhesive agent 113. In association with a reduction in size of the printing device substrate 106, securement of the required molding accuracy or machining accuracy has become difficult. Therefore, the position of the supply passage 112 of the supporting member 107 may vary in terms of positional accuracy with respect to a reference position of the supporting member 107.

In the case described above, as illustrated in FIG. 6, relative positioning of the wall 111*a* of the supply port 111 of the printing device substrate 106 and the wall 112*a* of the supply passage 112 of the supporting member 107 may be shifted from each other. In such a case, since the adhesive agent 113 is applied onto an end surface 112*b* of the wall 112*a* of the supply passage 112, center positions of the wall 111*a* of the supply port 111 and the wall 112*a* of the supply passage 112 in the thickness direction of the walls 111*a* and 112*a* are shifted from each other as illustrated in FIG. 6.

When an end surface 111*b* of the wall 111*a* of the supply port 111 is brought toward the end surface 112*b* of the wall 112*a* of the supply passage 112 and stuck thereto in such a shifted state, the adhesive agent 113 is not likely to be flattened out evenly on both sides of the wall 111*a* of the supply port 111 of the printing device substrate 106 in the thickness direction. Therefore, as illustrated in FIG. 6, the adhesive agent 113 is not adhered to both side surfaces (wall surfaces) 111*c* of the wall 111*a* of the supply port 111, but is adhered only to one of the side surfaces 111*c* of the wall 111*a*.

In a case where the wall 111*a* of the supply port 111 is fixed to the wall 112*a* of the supply passage 112 in the state described above, an adhesion strength between the wall 111*a* of the supply port 111 and the wall 112*a* of the supply passage 112 is weak. Therefore, when deformation or the like occurs in the supporting member 107, since the adhesion strength between the walls 111*a* and 112*a* is weak, an adhered portion is separated, and hence ink may enter from the supply port 111 from a space adjacent thereto.

When such a state occurs, in an ink jet printhead provided with a plurality of types of ink in different colors, ink enters the supply port 111 and is mixed in the supply port 111 adjacent thereto with the wall 111*a* of the supply port 111 interposed therebetween, and the quality of a printed result is significantly reduced.

This disclosure provides a method of manufacturing a liquid discharge head that maintains a state in which a wall of a supply port is adhered to a wall of a supply passage stably even though positions of the wall of the supply port and the wall of the supply passage are displaced from each other.

SUMMARY OF THE INVENTION

This disclosure provides a method of manufacturing a liquid discharge head in which a device substrate having an energy generating element configured to generate energy to discharge liquid and a supply port for supplying liquid to the energy generating element and a supporting member having a supply passage communicating with the supply port and configured to support the device substrate are bonded with each other an adhesive agent including:

a first step of applying the adhesive agent to an end surface of a wall which forms the supply passage;

a second step of flattening out the adhesive agent on the end surface of the wall of the supply port in the height direction intersecting the end surface by moving the end surface of the wall of the supply port and the end surface of the wall of the supply passage toward each other so that a ridge line formed by an end surface of an wall which forms the supply port and the side surface of the wall of the supply port intersecting the end surface enters the interior of the adhesive agent applied to the wall of the supply passage; and a third step of moving the ridge line of the wall of the supply port in a direction along the end surface of the wall of the supply port in the state of being positioned in the interior of the adhesive agent and fixing the end surface of the wall of the supply port to the end surface of the wall of the supply passage with the adhesive agent.

Further features of the present invention will become apparent from the following description of exemplary embodiments with reference to the attached drawings.

DESCRIPTION OF THE EMBODIMENTS

Figure 1:
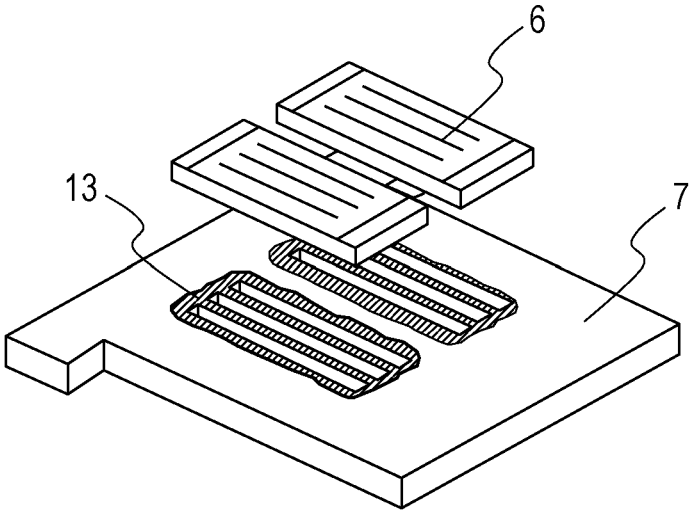
FIG. 1 is an exploded perspective view illustrating an inkjet printhead manufactured by a manufacturing method of an embodiment.

Referring now to the drawings, detailed description of embodiments of this disclosure will be given below.

First of all, an inkjet printhead (hereinafter, referred to as a printhead) will be described as an example of a liquid discharge head manufactured using a manufacturing method of the embodiment disclosed here and configured to discharge a liquid.

The printheads of the embodiments are manufactured by either one of methods of manufacturing according to first and second embodiments described later.

The printheads of the embodiments are inkjet printheads employing a system in which an electrothermal converter configured to generate heat energy to cause film boiling in the ink in accordance with an electric signal is used.

In addition, the printheads of the embodiments disclosed here are so-called, side shooter type inkjet printheads in which discharge ports that allow the ink to be discharged therefrom and the electrothermal converters that cause the ink to be discharged are arranged so as to face each other.

(1) Printhead

FIG. 1 illustrates an exploded perspective view of a printhead 1 of an embodiment. As illustrated in FIG. 1, the printhead 1 includes printing device substrates 6 configured to discharge ink, a supporting member 7 configured to support the printing device substrates 6, and flexible wiring members (not illustrated) electrically connected to electrode portions of the supporting member 7. In the printhead 1, the printing device substrates 6 are bonded and fixed to the supporting member 7 with an adhesive agent 13.

(1-1) Printing Device Substrate

Figure 2:
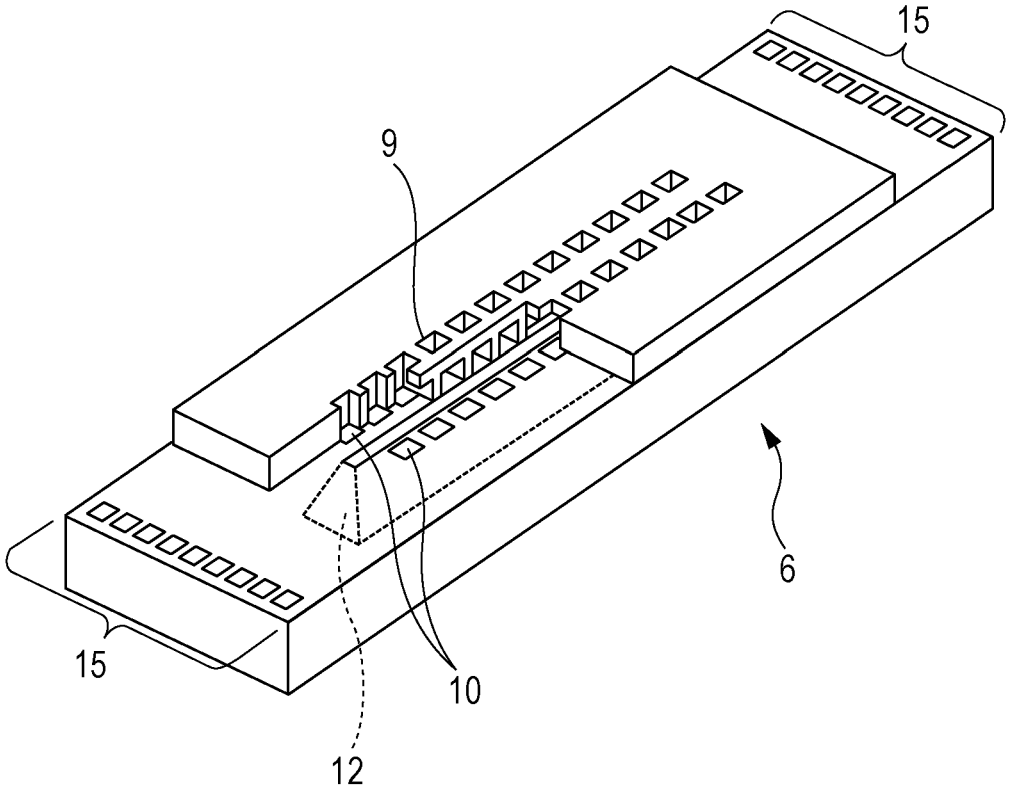
FIG. 2 is a perspective view illustrating a printing device substrate used in the manufacturing method of the embodiment.

FIG. 2 is a partially cut away perspective view for explaining a configuration of the printing device substrates 6.

As illustrated in FIG. 2, the printing device substrates 6 each include a plurality of discharge ports 9 for discharging ink, electrothermal converting elements 10 functioning as energy generating elements configured to generate energy for discharging ink, and a supply port 11 to which the ink is supplied.

The printing device substrates 6 each include a Si substrate having a thickness on the order of 0.5 mm to 1 mm, for example. In each of the printing device substrates 6, a supply passage 12 is formed in the form of a long groove-shaped through hole which forms an ink flow channel by using a machining method such as anisotropic etching or sand blasting utilizing the crystal orientation of Si as illustrated in FIG. 2.

The Si substrate includes one line of a plurality of the electrothermal converting elements 10 arranged on both sides of the supply passage 12 in the short side direction with the long groove-shaped supply passage 12 of a supporting member 7 described later interposed therebetween. The printing device substrates 6 are each formed with electric wiring (not illustrated) formed of Al for supplying power to the electrothermal converting elements 10. The electrothermal converting elements 10 and the electric wiring are formed by utilizing an existing film formation technology.

The two rows of electrothermal converting elements 10 are shifted with respect to each other so as to form a zigzag pattern. In other words, the electrothermal converting elements 10 are arranged so as to be shifted slightly in the row direction with respect to each other so that the positions of the discharge ports 9 in the respective rows are not aligned with each other in the direction orthogonal to the direction of the row.

In the printing device substrates 6, the ink supplied from the supply passage 12 is discharged from the discharge ports 9 opposing the respective electrothermal converting elements 10 due to the pressure of air bubbles generated by heat generation of the respective electrothermal converting elements 10.

(1-2) Supporting Member

As illustrated in FIG. 2, the supporting member 7 includes the long groove-shaped supply passage 12 as a supply passage communicating with the supply port 11 of the printing device substrate 6. The supply port 11 and the supply passage 12 communicate with each other and thereby form an ink flow channel (flow channel).

The supporting member 7 is provided with electrode portions 15 at both end portions thereof on a main surface thereof.

The supporting member 7 is formed of ceramic in a rectangular plate shape for example.

The adhesive agent 13 to be used for bonding the printing device substrates 6 and the supporting member 7 to each other is preferably an adhesive agent having low viscosity, relatively low curing temperature, is cured in relatively short time, exhibiting a relatively high hardness after being cured, and concurrently having an ink-resistant property.

Examples of the adhesive agent 13 as described above include a thermosetting adhesive agent containing, for example, an epoxy resin as a main component. When using the thermosetting adhesive agent, the thickness of the adhesive agent (adhesive layer) in the direction orthogonal to an end surface 12*b* of a wall 12*a* of the supply passage 12 is preferably set to a thickness on the order of 60 μm.

Subsequently, a manufacturing method of the embodiment which allows the adhesive agent 13 to be reliably adhered to side surfaces 11*c* on both sides of a wall 11*a* of the supply port lion the printing device substrate 6 will be given below.

First Embodiment

A manufacturing method of a first embodiment will be described below.

Figure 3:
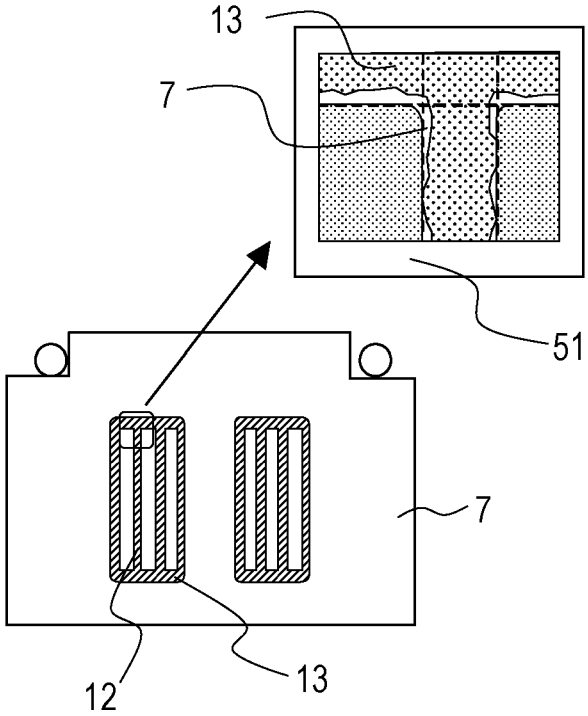
FIG. 3 is a schematic view for explaining a state of detecting the position of a wall of a supply passage and a method of bonding a wall of the supply port and the wall of the supply passage of the embodiment.

FIG. 3 is a plan view for explaining the supporting member 7 in the manufacturing method of the first embodiment. FIG. 3 is a schematic view for explaining the state of positioning the supporting member 7 at a predetermined position and detecting the position of the wall 12*a* of the supply passage 12 by image processing.

In the method of manufacturing the printhead of the first embodiment, the electrothermal converting elements 10 that generate energy for discharging ink and the printing device substrate 6 having the supply port 11 from which the ink is supplied are fixed to the supporting member 7 having the supply passage 12 communicating with the supply port 11 with the adhesive agent 13. Accordingly, an end surface 11*b* of the wall 11*a* which forms the supply port 11 and the end surface 12*b* of the wall 12*a* which forms the supply passage 12 are bonded to each other to form the ink flow channel.

The manufacturing method of the first embodiment includes a first step for applying the adhesive agent 13 onto the end surface 12*b* of the wall 12*a* of the supply passage 12, and a second step for flattening out the adhesive agent 13 on the end surface 11*b* of the wall 11*a* of the supply port 11 in a height direction orthogonal to (intersecting) the end surface 11*b*.

In the second step, the end surface 11*b* of the wall 11*a* and the end surface 12*b* of the wall 12*a* are brought toward each other so that a ridge line 14 formed by the end surface 11*b* of the wall 11*a* of the supply port 11 and the side surfaces 11*c* of the wall 11*a* orthogonal to (intersecting) the end surface 11*b* enters the interior of the adhesive agent 13 applied to the wall 12*a*. The ridge line 14 is one of two ridge lines in the thickness direction of the wall 11*a* of the supply port 11, and is the ridge line 14 which is closer to the wall 12*a* of the supply passage 12 on the side of one of the side surfaces 11*c* (the side surface side) in the direction along (parallel to) the end surface 11*b* of the wall 11*a* of the supply port 11.

The manufacturing method of the first embodiment includes a third step for moving the ridge line 14 of the wall 11*a* in the direction along the end surface 11*b* of the wall 11*a* in a state of being positioned in the interior of the adhesive agent 13 and fixing the end surface 11*b* of the wall 11*a* to the end surface 12*b* of the wall 12*a* with the adhesive agent 13. In the third step, the wall 11*a* of the supply port 11 and the wall 12*a* of the supply passage 12 are fixed to each other in a state in which center positions of the respective walls 11*a* and 12*a* in the thickness direction are displaced from each other.

In the third step, when flattening out the adhesive agent 13 in the height direction by using the wall 11*a* of the supply port 11, the position of the end surface 12*b* of the wall 12*a* of the supply passage 12 in the height direction is detected. On the basis of the result of detection, a predetermined distance is set between the end surface 11*b* of the wall 11*a* of the supply port 11 and the end surface 12*b* of the wall 12*a* of the supply passage 12 in the height direction. In a state in which the predetermined distance is set, the wall 11*a* of the supply port 11 is moved to a predetermined fixing position in the direction away from the other side surface 11*c* of the wall 11*a* of the supply port 11 with respect to the direction parallel to the end surface 11*b* of the wall 11*a*.

In the manufacturing method of the embodiment disclosed here, as illustrated in FIG. 3, positioning of the supporting member 7 and the printing device substrates 6 is performed by using an image processing monitor 51.

Positioning of the supporting member 7 having the adhesive agent 13 applied onto the end surface 12*b* of the wall 12*a* of the supply passage 12 is performed with respect to a predetermined reference in a bonding device, which is not illustrated. Subsequently, image processing is performed by photographing the wall 12*a* of the supply passage 12 by using a camera (not illustrated) provided in the bonding device. Accordingly, the position of the wall 12*a* of the supply passage 12 is detected and the position of the wall 12*a* of the supply passage 12 in the bonding device is calculated.

Subsequently, as illustrated in FIG. 4A to FIG. 4D, the wall 11*a* of the supply port 11 of the printing device substrate 6 is positioned at a predetermined position in the bonding device in order to stick the printing device substrate 6 to a predetermined position on the supporting member 7.

Figures 4A, 4B, 4C, 4D:
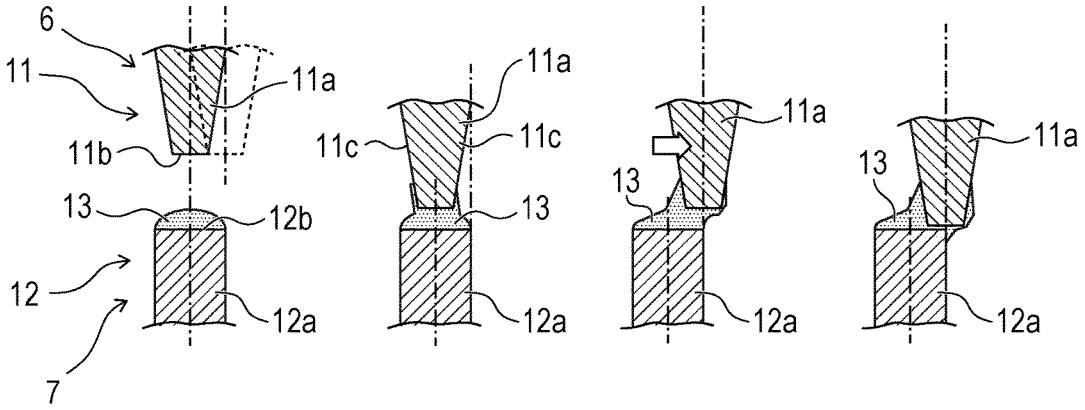
FIG. 4A to FIG. 4D are cross-sectional views for explaining a method of manufacturing the inkjet printhead of a first embodiment.

Subsequently, as illustrated in FIG. 4A, the position of the printing device substrate 6 is corrected so that the positions of the wall 11*a* of the supply port 11 and the wall 12*a* of the supply passage 12 match by using the positional data of the wall 12*a* of the supply passage 12 of the supporting member 7 in the bonding device calculated in the manner as described above.

Subsequently, as illustrated in FIG. 4B, the wall 11*a* is moved downward to a predetermined height so that the ridge line 14 of the wall 11*a* of the supply port 11 enters the interior of the adhesive agent 13 applied onto the end surface 12*b* of the wall 12*a* of the supply passage 12, and the end surface 11*b* of the wall 11*a* and the end surface 12*b* of the wall 12*a* are moved toward each other.

In a state illustrated in FIG. 4B, the adhesive agent 13 on the end surface 12*b* of the wall 12*a* is sufficiently flattened out at the center position of the wall 11*a* of the supply port 11 in the thickness direction with respect to the center position of the end surface 12*b* in the thickness direction. Accordingly, the adhesive agent 13 spreads over and reaches the side surfaces 11*c* of the wall 11*a* of the supply port 11, and then is adhered thereto.

As illustrated in FIG. 4C, the wall 11*a* of the supply port 11 is moved with respect to the wall 12*a* of the supply passage 12 in the direction parallel to the end surface 11*b* of the wall 11*a* to a predetermined fixing position specified in the bonding device. Accordingly, the wall 11*a* of the supply port 11 is moved in a state in which the adhesive agent 13 is adhered to the both side surfaces 11*c*.

Finally, as illustrated in FIG. 4D, the wall 11*a* of the supply port 11 is moved downward to a desired position in the height direction on the end surface 12*b* of the wall 12*a* of the supply passage 12, and the end surface 11*b* of the wall 11*a* is brought into abutment with the end surface 12*b* of the wall 12*a*.

With this manufacturing method, the printing device substrate 6 may be bonded to a predetermined position with respect to the reference position of the supporting member 7 in the state in which the adhesive agent 13 is adhered to the side surfaces 11*c* of the wall 11*a* of the supply port 11 of the printing device substrate 6.

According to the manufacturing method of the embodiment disclosed here, the adhesive agent 13 is flattened out by the end surface 11*b* of the wall 11*a* of the supply port 11 so that at least one of the ridge lines 14 of the wall 11*a* of the supply port 11 enters the interior of the adhesive agent 13 applied onto the end surface 12*b* of the wall 12*a* of the supply passage 12. After the adhesive agent 13 is flattened out, the wall 11*a* of the supply port 11 is moved to the predetermined fixing position in that state, so that the adhesive agent 13 is reliably adhered to the side surfaces 11*c* on the wall 11*a* of the supply port 11. Consequently, according to the embodiment, the adhesion strength after the fixation of the printing device substrate 6 and the supporting member 7 is increased, and the operation reliability of the printhead 1 is improved.

Second Embodiment

Figures 5A, 5B, 5C, 5D, 5E:
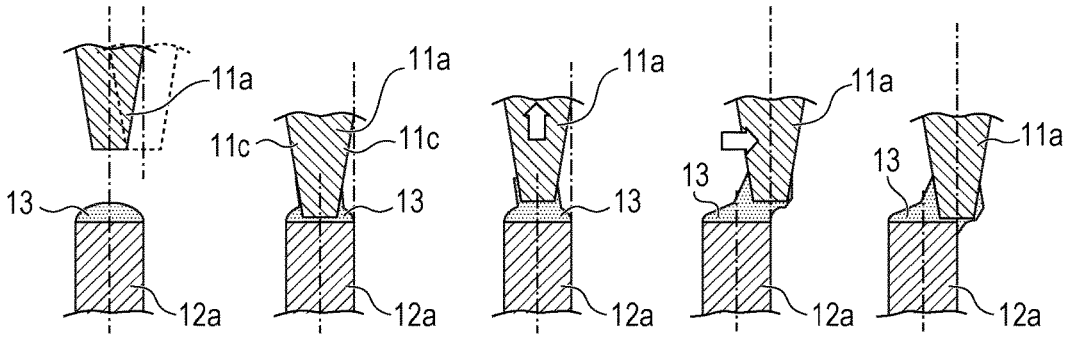
FIG. 5A to FIG. 5E are cross-sectional views for explaining a method of manufacturing the inkjet printhead of a second embodiment.
Figure 6:
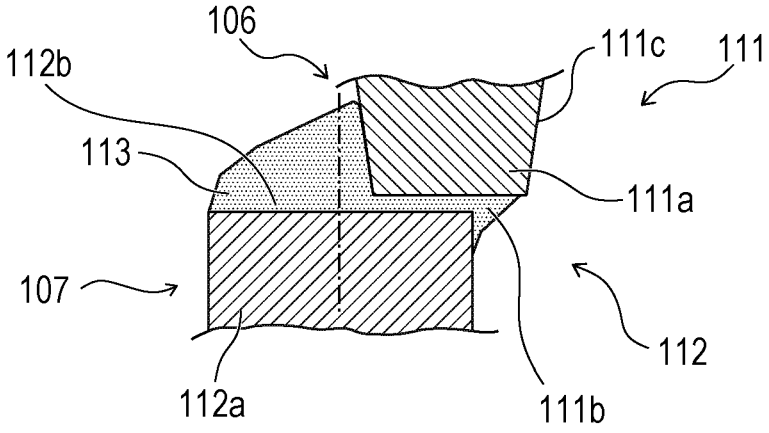
FIG. 6 is a cross-sectional view illustrating a state in which a wall of a supply port of a printing device substrate and a wall of a supply passage of a supporting member are fixed with an adhesive agent of the related art.

A manufacturing method of a second embodiment will be described below. FIG. 5A to FIG. 5B are schematic views for explaining the manufacturing method of the second embodiment.

The manufacturing method of the second embodiment is preferably applied to the first embodiment in a case where the height of the sticking position on the supporting member 7, that is, the position of the end surface 12*b* of the wall 12*a* of the supply passage 12 is varied. Also, the manufacturing method of the second embodiment is also applied preferably to a case where the height of the end surface 11*b* of the wall 11*a* of the supply port 11 of the printing device substrate 6 is changed due to the influence of warp or the like of the printing device substrate 6.

As illustrated in FIG. 5A, in the same manner as the first embodiment, the position of the wall 12*a* of the supply passage 12 provided in the supporting member 7 is detected by the image processing. Subsequently, the position is corrected so that the center position of the end surface 12*b* of the wall 12*a* of the supply passage 12 matches the center position of the end surface 11*b* of the wall 11*a* of the supply port 11 of the printing device substrates 6.

As illustrated in FIG. 5B, the wall 11*a* of the supply port 11 is moved downward onto the end surface 12*b* of the wall 12*a* of the supply passage 12 in a state illustrated in FIG. 5A, and displacement of a finger (not illustrated) which holds the printing device substrate 6 or a change of load is detected in the bonding device.

The position resulted from the displacement or the load change described above is set at the position where the printing device substrates 6 is pressed against the supporting member 7. Then, the wall 11*a* of the supply port 11 of the printing device substrate 6 is moved by a desired amount in the direction away from the wall 12*a* of the supply passage 12 of the supporting member 7 as illustrated in FIG. 5C with reference to the position where the printing device substrate 6 is pressed against the supporting member 7.

In this manner, in the third step of the embodiment disclosed here, the end surface 11*b* of the wall 11*a* of the supply port 11 and the end surface 12*b* of the wall 12*a* of the supply passage 12 are moved away from each other in the height direction orthogonal to (intersecting) the respective end surfaces 11*b* and 12*b* after the adhesive agent 13 has flattened out in the height direction by the wall 11*a* of the supply port 11. Accordingly, a predetermined distance is set between the end surface 11*b* of the wall 11*a* in a state of securing the predetermined distance of the supply port 11 and the end surface 12*b* of the wall 12*a* of the supply passage 12 in the height direction.

Subsequently, in the same manner as the third step described above in the first embodiment, the wall 11*a* is moved to a predetermined fixing position with respect to the direction parallel to the end surface 11*b* of the wall 11*a* as illustrated in FIGS. 5D and 5E. Finally, the end surface 11*b* of the wall 11*a* is moved downward to a desired height with respect to the end surface 12*b* of the wall 12*a* of the supply passage 12, and the end surface 11*b* of the wall 11*a* and the end surface 12*b* of the wall 12*a* are stuck and fixed.

By applying the embodiment disclosed here, when the position to stick the wall 11*a* of the printing device substrate 6, that is, the height of the end surface 12*b* of the wall 12*a* of the supporting member 7 is varied, the adhesive agent 13 may be adhered stably to the both side surfaces 11*c* of the wall 11*a* of the supply port 11 for sticking. Also in the case where the sticking position, that is, the height of the end surface 11*b* of the wall 11*a* of the supply port 11 varies from one printing device substrate 6 to another due to the warp or the like of the printing device substrate 6, the adhesive agent 13 may be adhered further stably to the both side surfaces 11*c* of the wall 11*a* of the supply port 11 for bonding.

In the embodiment disclosed here, detection of the height of the end surface 12*b* of the wall 12*a* of the supply passage 12 of the supporting member 7 is performed by monitoring (detecting) the displacement or the load change of the finger (not illustrated) which holds the printing device substrate 6. However, this disclosure is not limited thereto. Even in a case where the detection of the height of the end surface 12*b* of the wall 12*a* of the supply passage 12 is performed by measurement using a laser displacement gauge or a contact displacement gauge, for example, the same advantages are achieved. A configuration of the bonding device used when implementing the manufacturing method of this disclosure and the detection device configured to detect the position of the wall may be selected as needed, and are not intended to limit a position detecting method used in this disclosure.

When moving the wall 11*a* of the supply port 11 with respect to the wall 12*a* of the supply passage 12, at least one of the walls may be moved while vibrating the same in a state in which the end surface 11*b* of the wall 11*a* of the supply port 11 and the end surface 12*b* of the wall 12*a* of the supply passage 12 are brought into abutment with each other. By moving while vibrating the wall, the wall 11*a* may be moved to a predetermined fixing position with respect to the direction parallel to the end surface 11*b* of the wall 11*a* and fixed while reducing a frictional force generated between abutting surfaces of the wall 11*a* and the wall 12*a*.

In the embodiment disclosed above, the wall 11*a* of the supply port 11 is moved with respect to the wall 12*a* of the supply passage 12. However, the wall 12*a* of the supply passage 12 may be moved with respect to the wall 11*a* of the supply port 11. In this case as well, the same advantages as in the embodiment disclosed here is achieved as long as the relative movement between the wall 11*a* of the supply port 11 and the wall 12*a* of the supply passage 12 is the same as those of the embodiment disclosed here.

As described thus far, according to the embodiments of this disclosure, the adhesive agent may be adhered reliably to the both side surfaces of the wall of the supply port of the device substrate, and hence an adhesive force between the wall of the supply port and the wall of the supply passage may be increased. Consequently, separation at the bonding surface defined between the end surface of the wall of the supply port and the end surface of the wall of the supply passage due to an external force caused by the deformation or the like of the supporting member may be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-018308, filed Feb. 1, 2013 which is hereby incorporated by reference herein in its entirety.

What is claimed is:

1. A method of manufacturing a liquid discharge head in which a device substrate having an energy generating element configured to generate energy to discharge liquid and a supply port for supplying liquid to the energy generating element and a supporting member having a supply passage communicating with the supply port and configured to support the device substrate are bonded to each other with an adhesive agent comprising:

a first step of applying the adhesive agent to an end surface of a wall which forms the supply passage;

a second step of flattening out the adhesive agent on the end surface of the wall of the supply passage in a height direction intersecting the end surface of the wall of the supply passage by moving the end surface of the wall of the supply port and the end surface of the wall of the supply passage toward each other so that a ridge line formed by the end surface of the wall which forms the supply port and the side surface of the wall of the supply port intersecting the end surface of the wall of the supply port enters the interior of the adhesive agent applied to the end surface of the wall of the supply passage; and a third step of moving the ridge line of the wall of the supply port in a direction parallel to the end surface of the wall of the supply port in the state of being positioned in the interior of the adhesive agent and fixing the end surface of the wall of the supply port to the end surface of the wall of the supply passage with the adhesive agent.

2. The method of manufacturing a liquid discharge head according to claim 1, wherein the third step includes fixing the wall of the supply port and the wall of the supply passage in a state in which center positions of the walls in a thickness direction are displaced from each other.

3. The method of manufacturing a liquid discharge head according to claim 1, wherein the third step includes moving the ridge line on the side of one of side surfaces of the wall of the supply port toward a side away from the other side surface of the wall of the supply port in the direction parallel to the end surface of the wall of the supply port.

4. The method of manufacturing a liquid discharge head according to claim 1, wherein the ridge line is one of the two ridge lines formed on the wall of the supply port in a thickness direction, which is located closer to the wall of the supply passage in the direction parallel to the end surface of the wall of the supply port.

5. The method of manufacturing a liquid discharge head according to claim 1, wherein the third step includes detecting the position in the height direction of the end surface of the wall of the supply passage when flattening out the adhesive agent using the wall of the supply port in the height direction and moving the wall of the supply port in a state of keeping a predetermined distance between the end surface of the wall of the supply port and the end surface of the wall of the supply passage in the height direction on the basis of a result of the detection.

6. The method of manufacturing a liquid discharge head according to claim 1, wherein the third step includes flattening out the adhesive agent using the end surface of the wall of the supply port in the height direction, then moving the end surface of the wall of the supply port and the end surface of the wall of the supply passage away from each other in the height direction intersecting the respective end surfaces and moving the wall of the supply port in a state of keeping the predetermined distance between the end surface of the wall of the supply port and the end surface of the wall of the supply passage in the height direction.

7. The method of manufacturing a liquid discharge head according to claim 5, wherein the third step includes moving the ridge line of the wall of the supply port in the direction parallel to the end surface of the wall of the supply port and then bringing the end surface of the wall of the supply port into abutment with the end surface of the wall of the supply passage, thereby fixing the end surface of the wall of the supply port to the end surface of the wall of the supply passage with the adhesive agent.

8. The method of manufacturing a liquid discharge head according to claim 5, wherein in the first step, the thickness of the adhesive agent to be applied to the end surface of the wall of the supply passage is set to be thicker than the predetermined distance to be secured between the wall of the supply port and the wall of the supply passage in the height direction when moving the wall of the supply port in the direction parallel to the end surface of the wall of the supply port in the third step.

* * * * *